United States Patent [19]

Liska

[11] Patent Number: 4,881,877

[45] Date of Patent: Nov. 21, 1989

[54] RADIAL PISTON PUMP

[75] Inventor: Georg Liska, Zimmerbach, Fed. Rep. of Germany

[73] Assignee: Zahnradfabrik Friedrichshafen, AG., Friedrichshafen, Fed. Rep. of Germany

[21] Appl. No.: 186,480

[22] PCT Filed: Feb. 25, 1987

[86] PCT No.: PCT/EP87/00109

§ 371 Date: May 6, 1988

§ 102(e) Date: May 6, 1988

[87] PCT Pub. No.: WO87/05366

PCT Pub. Date: Sep. 11, 1987

[30] Foreign Application Priority Data

Apr. 7, 1986 [LU] Luxembourg ..... 123

[51] Int. Cl.[4] ..... F04B 1/14

[52] U.S. Cl. ..... 417/270

[58] Field of Search ..... 417/270, 273; 91/489; 184/6.5, 6.6

[56] References Cited

U.S. PATENT DOCUMENTS

| | | | |
|---|---|---|---|
| 2,298,749 | 10/1942 | Buschmann | 184/6.5 |
| 3,289,606 | 12/1966 | Bosch | 91/489 |
| 3,885,893 | 5/1975 | Glock | 417/273 |
| 4,681,514 | 7/1987 | Griese | 417/273 |

FOREIGN PATENT DOCUMENTS

| | | |
|---|---|---|
| 165876 | 12/1985 | European Pat. Off. . |
| 3522796 | 3/1986 | Fed. Rep. of Germany . |

*Primary Examiner*—William L. Freeh

*Attorney, Agent, or Firm*—Albert M. Zalkind

[57] ABSTRACT

A pressure-limiting valve coaxial with the drive shaft is installed in a multi-piston pump. The valve is biased by a compression spring to closed condition to prevent output flow from the pump into a pressure-collecting dome of the housing. The spring is supported for reaction against a gasket having a throttle bore leading directly for flow toward a return chamber wherein the end of the pump shaft is a radial wall. When pressure in the pressure-collecting dome reaches a certain value, it will open the pressure-limiting valve against spring bias to relieve pressure through the throttle bore back into the suction channels of the pump. However, the relief flow through the throttle bore causes heating of the oil, an effect which is an important purpose of the invention on pump start-up. Thus, by making the return flow of reduced viscosity due to heating, such oil impinging against the shaft of the pump does not cause a sudden shift of the shaft against the pump housing. This reduces impact noises otherwise caused by cold oil of higher viscosity. Further, the positioning of the throttle bore directs the jet of oil into an axial bore in the drive shaft which oil subsequently is distributed to bearings which lubricates the shaft with warm, low viscosity oil.

9 Claims, 1 Drawing Sheet

RADIAL PISTON PUMP

BACKGROUND OF THE INVENTION

A radial multi-piston pump (DE-OS No. 35 22 796, for example) of the kind used herein has a pressure limiting valve that is coaxial with the drive shaft and is accommodated in an intermediate cover. The pressure limiting valve protects the pump and a consuming device connected with it against overloading after a maximum pressure determined by a spring is reached. The upstream high-pressure side of the pressure limiting valve is exposed to a collecting chamber that receives the oil under pressure from all pistons. The outlet side of the pressure limiting valve is connected with a return chamber that is closed by the front surface of the drive shaft.

Impact noises develop when such a radial piston pump is cold started. If the driver turns an auxiliary power steering mechanism supplied by the pump to highest pressure to get out of a parking space, the permissible maximum pressure builds up and the pessure limiting valve opens. This lets the volume being delivered by the pump at the moment to flow back to the return chamber. A back pressure is developed in the return chamber by the still viscous oil that, because of necessary shaft axial play, suddenly moves the drive shaft against the pump casing. This is the cause of the impact noises. The possibility of letting the oil flow off to the suction side of the pump more quickly through several drilled holes, instead of only one, does exist. However, a resulting unfavorable cost of production results. Also, the oil mass that is present in the entire pump and in the suction line acts as retardant to flow. As a result, the pump can only suck in a small volume initially when the oil is cold.

The objects of the invention are to eliminate the impact noises caused by a cold start; improve the pump's suction efficiency, improve the bearing lubrication efficiency while the pump is warming up by warming the return oil; maintain a low manufacturing cost, all effected by the main feature of the invention, viz., to warm return oil on start up.

BRIEF DESCRIPTION OF THE INVENTION

In accordance with the main feature of the invention, a throttle means is installed downstream of the pressure limiting valve. In construction this throttle is a bore provided in a disc-like support which support is already present as a reaction support for the compression spring of the pressure limiting valve.

The throttle converts the kinetic energy of the oil into heat energy as the oil flows through the throttle to a return chamber so that the oil's viscosity decreases. The oil flows from the return chamber more easily, so that the back pressure no longer suffices to impact against the drive shaft. Furthermore, the pump cylinders reach full volume more quickly, since the pistons suck in the warmer oil more rapidly. The warmer oil also improves the bearing lubrication. The throttle provided in the spring support being merely a flow throttling bore provided therein has no significant expense.

A detailed description of the invention now follows in conjunction with the drawing in which.

Figure 1:
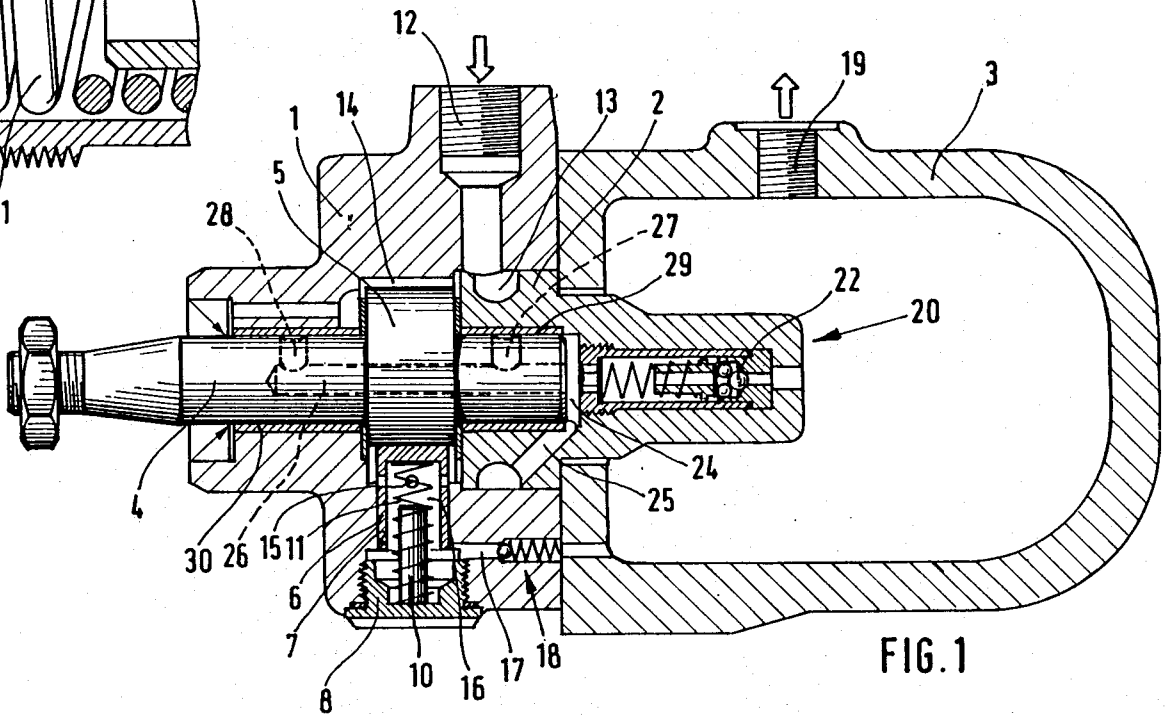
FIG. 1 shows a radial piston pump in longitudinal section.
Figure 2:
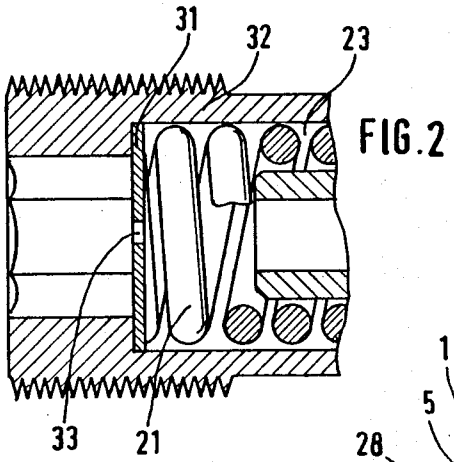
FIG. 2 shows an enlarged section of the pressure limiting valve and throttling bore.

The radial piston pump has a housing 1, an intermediate cover 2, and a dome 3 as a collecting chamber. A shaft 4 with an eccentric 5 operates several pump pistons such as pistons 6 circumferentially arranged radially to the axis of the shaft in the usual manner. The pistons reciprocate in drilled cylinders 7. Screw caps 8 with guide bolts 10 for pressure springs 11 close the cylinders 7. The pressure springs 11 hold the pistons 6 next to the surface of the circumference of the eccentric 5. An oil tank (not shown) connects to a suction chamber 14 via a suction inlet 12 and a ring channel 13. The suction chamber 14 surrounds all the piston bases facing the eccentric 5. Each conveyor piston 6 has feed inlets 15 that act together with the suction chamber 14 in a known manner when the shaft 4 is rotating. During the compression stroke, interior spaces 16 in the pistons 6 are in turn connected with the collecting chamber of the dome 3 through pressure ducts 17 and outlet valves 18. Dome 3 is connected with a consuming device (not shown) through a discharge outlet 19. A pressure limiting valve 20 coaxial with the shaft 4 is installed in the intermediate cover 2. That valve protects the pump and the consuming device against overloading. If the pressure in the dome 3 rises to a certain maximum value determined by the closing bias of a spring 21 (FIG. 2), the ball 22 of 20 opens. The oil can escape into the ring channel 13 through the hollow space 23 (FIG. 2) around the spring and via a return chamber 24 (FIG. 1) and a transverse bore 25. The pistons then suck the oil into the cylinders again. The shaft 4 supplies bearing means such as bearings 29 and 30 with oil through an axial drilled bore 26 and radially drilled bores 27 and 28.

The spring 21 is compressed against a gasket means such as a gasket 31 for reaction support in a housing 32 of the pressure limiting valve. In accordance with the invention, the gasket 31 has a throttle bore 33 which effects throttle means and which throttle bore is coaxial with bore 26. The throttle has a flow restriction effect operative to convert the kinetic energy of the return oil to heat energy. Upon start up, cold oil pressure causes the pressure limiting valve to open and flow through the throttle causes a greatly heated jet of oil to flow directly into the axial drilled hole 26 and to the bearings 29 and 30, in the critical warming-up phase. Thus, when the bearings are under the greatest stress they are supplied with thinner lubricating oil. Due to a quicker heating of the oil, an improved bearing lubrication and consequently good noise suppression are also obtained. The warmer oil can flow back more quickly into the ring channel 13 from the return chamber 24 through the transverse drilled hole 25 to enhance pump suction.

It will thus be apparent that the basic principle of the invention as carried out in a simple change over the prior art brings about a vast improvement in operation all as set forth hereinabove by operation of a kinetic to heat conversion throttle.

I claim:

1. In a multi-piston pump of the kind having a plurality of radially arrayed pistons having means for actuation in sequential order by a drive shaft (4) and including pressure limiting valve means (20) biased to closed position by spring means (21) wherein said pressure limiting valve means is intermediate a pressure-collecting chamber means (3) and an end surface of the drive shaft; with return means (24, 25) for return flow to a suction inlet (12) of the pump upon opening of said pressure limiting valve;

the improvement comprising kinetic to heat energy converting throttle means being disposed to throttle flow from said pressure limiting valve means to said return means wherein said flow impinges on said end surface of said drive shaft upon opening of such pressure limiting valve means and wherein return flow through said throttle means of initially cold oil is thereby heated and rendered less viscous for recirculating to said suction inlet of said pump and also reducing impact of return oil against the end of said drive shaft for noise reduction in the operation of said pump.

2. In a multi-piston pump as set forth in claim 1, including support means (31) disposed intermediate said pressure limiting valve means and said end surface of said drive shaft; said throttle means being bore means through said support means, said spring means being held in compression by said support means to bias closed said pressure limiting valve means.

3. In a multi-piston pump as set forth in claim 1, including bearing means comprising bearings (29, 30) for said drive shaft and lubricating means (26, 27, 29) providing communication of heated return oil for lubricating said bearings.

4. In a multi-piston pump as set forth in claim 1, said throttle means comprising support means (31) disposed intermediate said pressure limiting valve means and said end surface of said drive shaft; said throttle means being bore means through said support means.

5. In a multi-piston pump as set forth in claim 3, said lubricating means comprising oil bores (26, 27, 28) in said drive shaft leading to said bearings and having communication with said throttle means.

6. In a multi-piston pump as set forth in claim 5, at least one said oil bore (26) being exposed in relation to with said throttle means to receive a direct jet therein of heated return oil from said throttle means.

7. In a multi-piston pump as set forth in claim 6, said one oil bore being an axial bore (26) in said drive shaft; said lubricating means including oil bores (27, 28) in said drive shaft communicating between said axial bore and said bearing means; said throttle means comprising a coaxial throttle bore (33).

8. In a multi-piston pump of the kind having a plurality of radially arrayed pistons having means for actuation in sequential order by a drive shaft (4) and including a pressure limiting valve (2) biased to closed position by a spring (21) wherein said pressure limiting valve is intermediate a pressure collecting chamber means (3) and an end surface of the drive shaft with return means (24, 25) for return flow to a suction inlet (12) of the pump upon opening of said pressure limiting valve;

the improvement wherein means comprising a throttle (33) is disposed to throttle flow from said pressure limiting valve to said return means so that said flow impinges on said end surface of said drive shaft upon opening of such pressure limiting valve and whereby return flow through said throttle of initially cold oil is thereby heated and rendered less viscous for recirculating to said suction inlet of said pump and also reducing impact of return oil against the end of said drive shaft for noise reduction in the operation of said pump; wherein said throttle effects a flow restriction which converts the kinetic energy of return flow to heat energy.

9. In a multi-piston pump of the kind having a plurality of radially arrayed pistons having means for actuation in sequential order by a drive shaft (4) and including a pressure limiting valve (20) biased to closed position by a spring (21) wherein said pressure limiting valve releases excess pressure oil to a return chamber (24) for receiving return flow to a suction inlet (12) of the pump upon opening of said pressure limiting valve; said return chamber being closed by an end of said drive shaft;

the improvement comprising throttle means having a throttle bore (33) being disposed to throttle return flow from said pressure limiting valve to said return chamber and operative to convert the kinetic energy of said return flow to heat energy wherein said drive shaft has lubrication means comprising an axial open ended bore (26) coaxial with said throttle bore (33) disposed to directly receive return flow therefrom for lubricant to said pump; said return flow impinges on said end surface of said drive shaft; whereby return flow through said throttle bore of initially cold oil is thereby heated and rendered less viscous for recirculating to said suction inlet of said pump and for lubrication of said pump and also for reducing impact of return oil against the end of said drive shaft to reduce noise in the cold start operation of said pump.

* * * * *